United States Patent [19]

Schmidt

[11] 3,961,573

[45] June 8, 1976

[54] REFUSE BIN WITH POWER-ACTUATED COMPACTOR BLADE

[75] Inventor: Lewis W. Schmidt, Rio Vista, Calif.

[73] Assignee: Blackwelders, Rio Vista, Calif.

[22] Filed: Mar. 3, 1975

[21] Appl. No.: 554,912

[52] U.S. Cl. ..... 100/100; 100/226; 100/233; 100/269 R; 214/83.3; 214/302 ; 292/128

[51] Int. Cl.[2] ..... B30B 1/34; B30B 15/06

[58] Field of Search ..... 214/83.3, 302; 100/100, 226, 233, 227, 228, 269 R ; 292/128

[56] References Cited

UNITED STATES PATENTS

| | | | |
|---|---|---|---|
| 1,133,048 | 3/1915 | Lundahl | 100/226 |
| 2,465,839 | 3/1949 | Bloomfield | 100/226 |
| 3,412,532 | 11/1968 | Nickla | 100/233 X |
| 3,478,909 | 11/1969 | Charles | 100/226 |
| 3,680,478 | 8/1972 | Beachner et al. | 100/233 |
| 3,709,389 | 1/1973 | Steltz | 100/233 X |
| 3,835,767 | 9/1974 | Peterson | 100/233 X |
| 3,881,407 | 5/1975 | Goar | 100/100 X |

*Primary Examiner*—Billy J. Wilhite
*Attorney, Agent, or Firm*—Roger B. Webster

[57] ABSTRACT

An improvement in a commercial, pick-up type, portable refuse bin—such as commonly in use outdoors at restaurants, stores, apartment houses, and other establishments—which has a normally-closed, releasably-latched lid openable when unlatched to permit deposit of refuse into the bin; the improvement comprising a normally closely underlying compactor blade hinged to the lid for downward swinging therefrom, and power means connected between the lid and compactor blade operative, when the lid is closed and latched, to forcefully swing said compactor blade downwardly into the bin to compact predeposited refuse therein.

6 Claims, 9 Drawing Figures

16
13
~2~
~2~
28
5
15
6
13
19
20
16
~7~
14
18
25
22
17
7
~7~
9
24
2
23
27
3
4
1
8
8

REFUSE BIN WITH POWER-ACTUATED COMPACTOR BLADE

BACKGROUND OF THE INVENTION

Portable refuse bins of the type described are generally of limited capacity which requires—under present practices—that the bins be frequently serviced; i.e., emptied by a refuse collector. In order to reduce the frequency of required emptying of such a bin and hence to enhance the economy in the use thereof, the present invention was conceived in a successful effort to provide for the bin to accept a larger load without increasing the bin size.

SUMMARY OF THE INVENTION

The present invention provides, as an important object, an improvement in a commercial, pick-up type, portable refuse bin—such as commonly in use outdoors at restaurants, stores, apartment houses, and other establishments—which has a normally-closed, releasably-latched lid openable when unlatched to permit deposit of refuse into the bin; the improvement comprising the inclusion, in association with the bin lid, of a power-actuated mechanism adapted to forcefully compact refuse in the bin whereby the latter can accept a larger load than otherwise and without increasing the bin size.

The present invention provides, as another important object, a portable refuse bin, as in the preceding paragraph, wherein said power-actuated mechanism comprises a normally closely underlying compactor blade hinged to the lid for downward swinging therefrom, and power means connected between the lid and compactor blade operative, when the lid is closed and latched, to forcefully swing said compactor blade downwardly into the bin to compact predeposited refuse therein.

The present invention provides, as a further object, a refuse bin with power-actuated compactor blade which is designed for ease and economy of manufacture.

The present invention provides, as a still further object, a practical, reliable, and durable refuse bin with power-actuated compactor blade, and one which is exceedingly effective for the purpose for which it is designed.

DESCRIPTION OF THE PREFERRED EMBODIMENT

Figure 5:
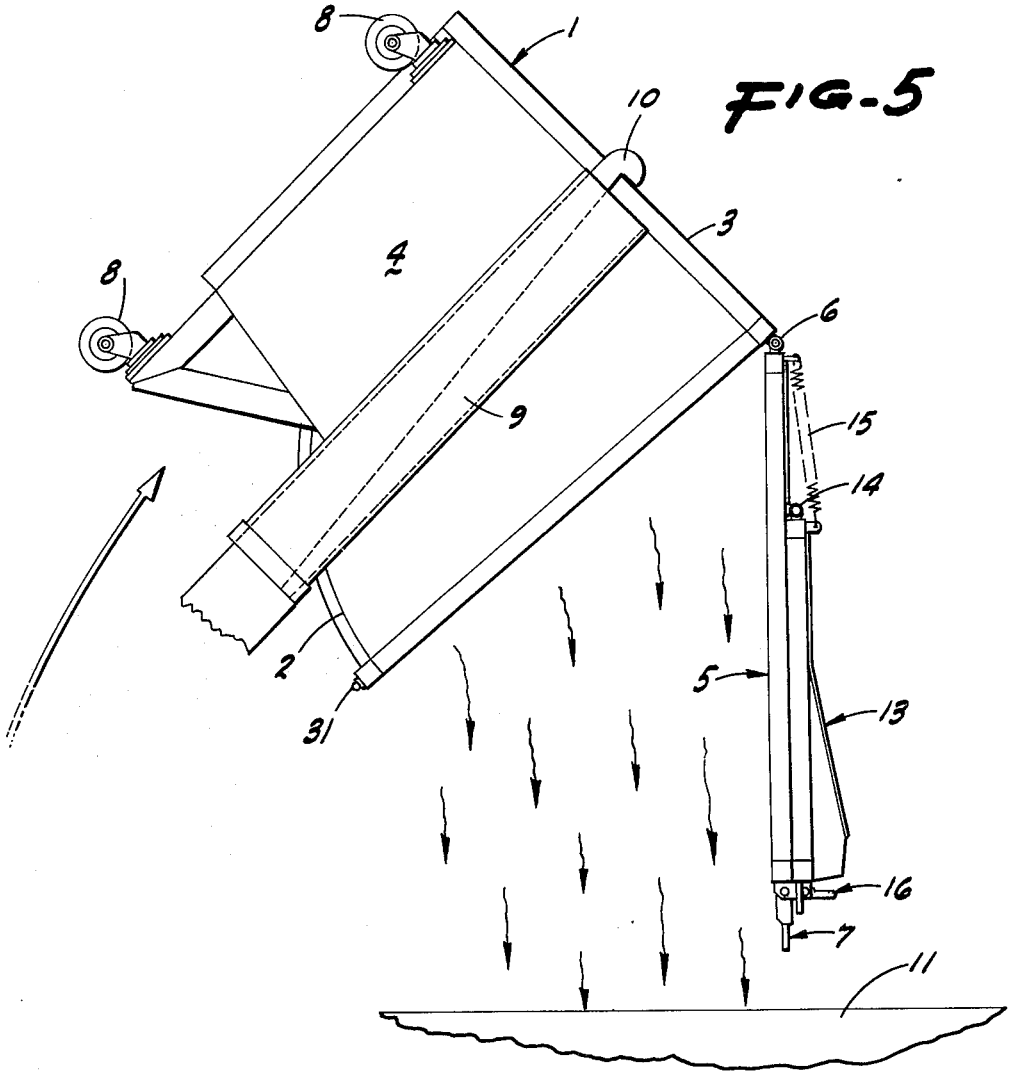
FIG. 5 is an end view of the refuse bin inverted, with the cover open, for discharge of the refuse from said inverted bin.
Figure 6:
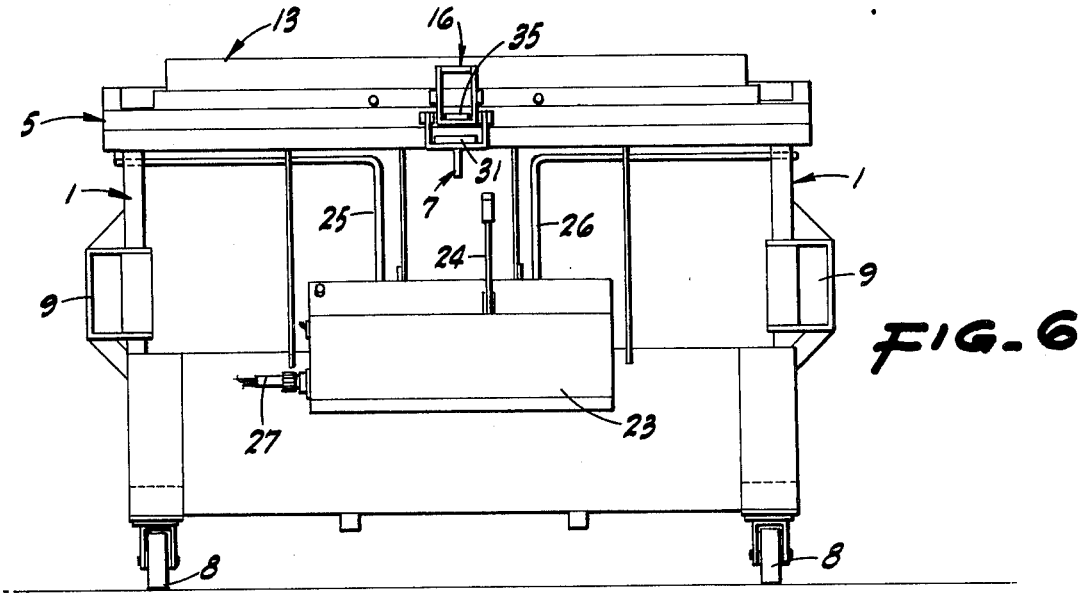
FIG. 6 is a front elevation—on reduced scale—of the refuse bin, with both the cover and the lid closed and latched.

Referring now more particularly to the drawings and to the characters of reference marked thereon, the present invention is embodied in a commercial, pick-up type, portable refuse bin, indicated generally at 1, which includes a front 2, a back 3, sides 4, and a normally closed full cover 5; such cover 5 being rear-hinged, as at 6, to the corresponding portion of the bin, and releasably front-secured to said bin by a latch 7. The bin 1—which is supported by caster wheels 8—is fitted on each side with an elongated, horizontal, forwardly opening socket 9 adapted to receive the forks 10 of a conventional refuse truck of the type adapted to swing the fork-engaged bin up and over the truck cab to an inverted position in which the cover is unlatched and gravitationally swings open to permit the refuse in the bin to discharge downwardly into the receiving body 11 of such truck. See FIG. 5.

Figure 1:
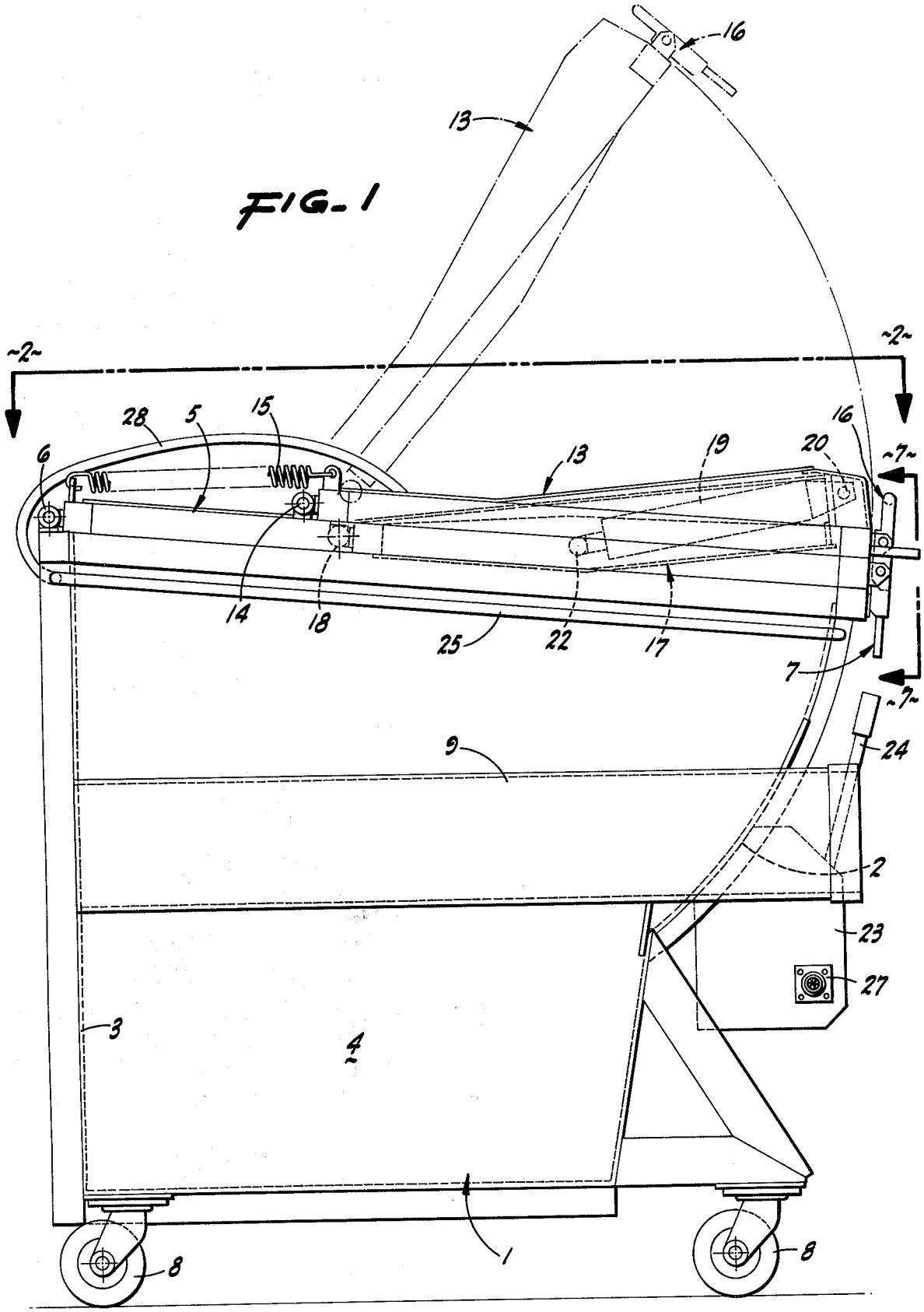
FIG. 1 is a side elevation of the refuse bin with power-actuated compactor blade; the lid being shown closed in full lines, and open in broken lines.
Figure 2:
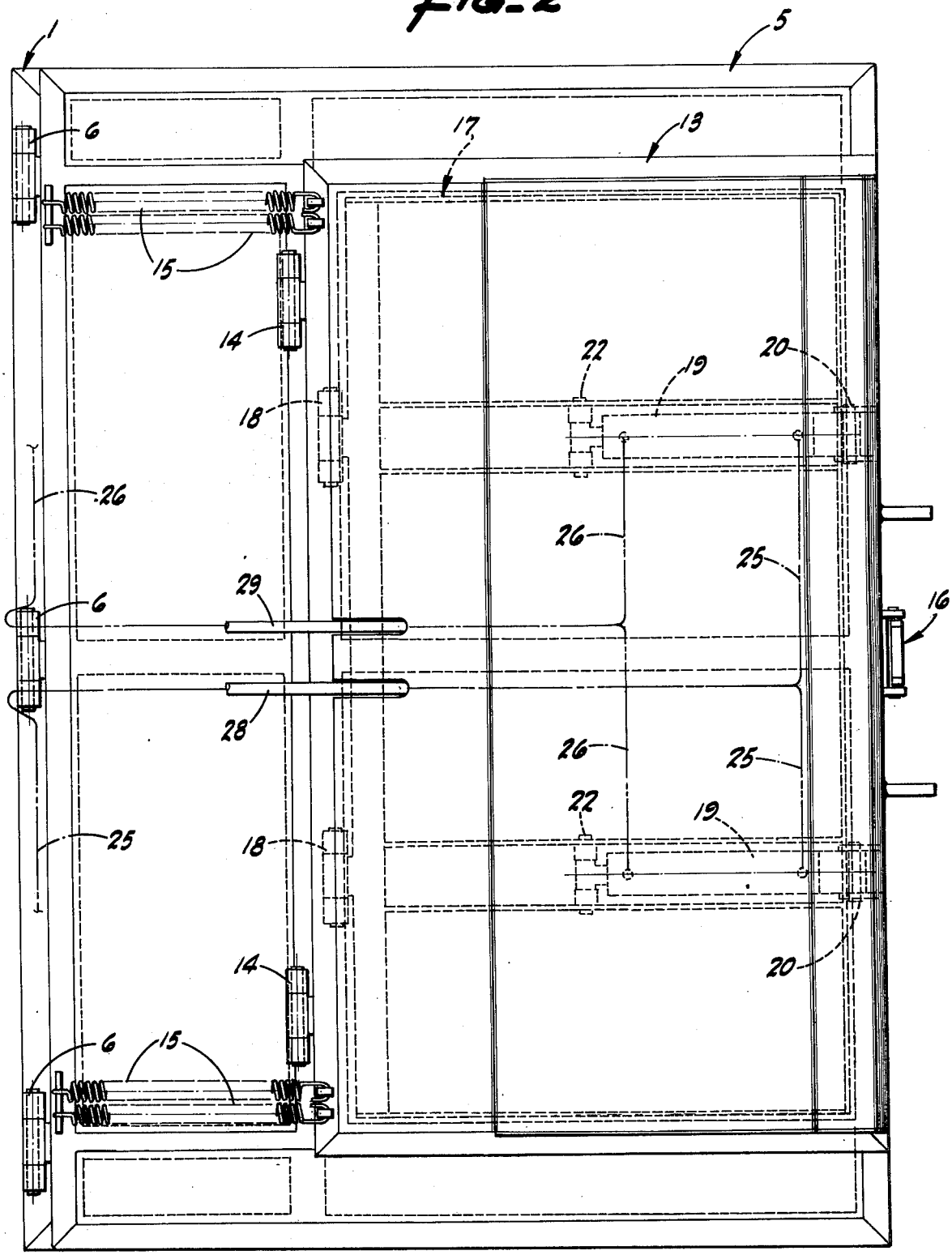
FIG. 2 is a top plan view of the bin with the lid closed; the view being taken substantially on line 2—2 of FIG. 1.
Figure 3:
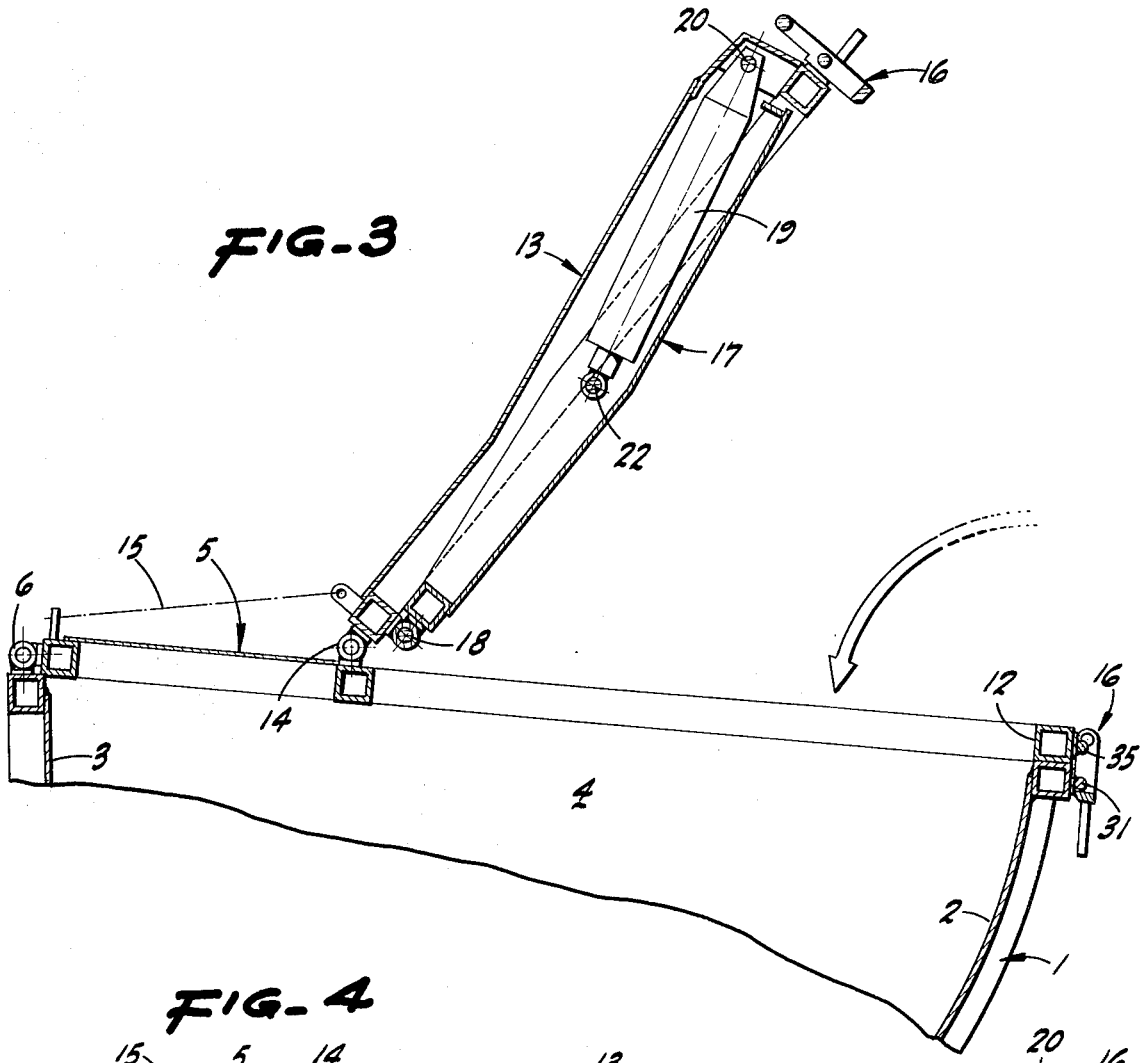
FIG. 3 is an enlarged, fragmentary, sectional elevation showing the lid unlatched and in raised position.
Figure 4:
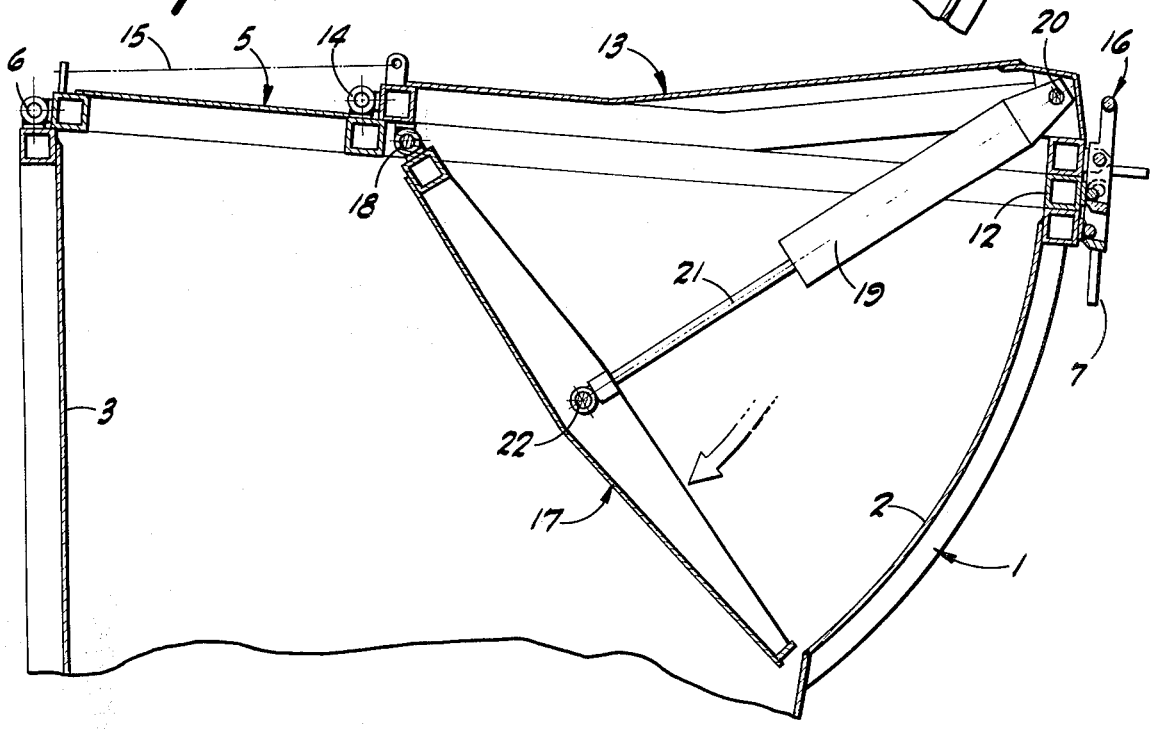
FIG. 4 is a similar view, but with the lid closed and latched, and the compactor blade swung downwardly in the bin.

The present invention comprises, in a refuse bin as above, the following improvement:

The normally latched full cover 5 of the bin 1 is formed with a rectangular opening 12 of reduced size relative to such cover; the opening 12 normally being closed by a lid 13 rear-hinged, as at 14, to the cover 5 for swinging movement between a closed position (as in FIG. 4) and an open position (as in FIG. 3). Such swinging motion of the lid 13 is counterbalanced by off-center springs 15 connected between the rear of the lid 13 and the rear of the cover 5. The lid 13 is normally but releasably maintained in closed position by a latch 16.

In use of the bin 1, the latch 16 is released and the lid 13 opened for the purpose of deposit of refuse through opening 12 and into the bin. With repetitive deposit—loosely—of refuse in the bin, it soon fills, and—unless such loose-filled refuse is compacted—the bin must be emptied more frequently than economy dictates. The present invention contemplates the compacting of such loose-filled refuse in the bin so that it may accept a larger load than otherwise.

To this end, a compactor blade 17—rectangular in plan, and dimensioned only slightly smaller than the lid 13—is disposed in normally raised, adjacent but spaced, underlying relation to said lid; the latter being peripherally skirted as shown. The compactor blade 17 is rear-hinged, as at 18, to the lid 13 for downward and rearward swinging motion about said hinges 18 as an axis, and through a substantial arc in the bin. The upper portion of the front 2 of the bin is curved, as shown, on an arc such that the front edge of the compactor blade 17, as it sweeps downwardly and rearwardly, closely follows such arcuate portion of the front of the bin. As will hereinafter appear, the compactor blade 17—upon the lid being closed and latched—is power-actuated so that its downward and rearward sweep into the bin is forceful; the refuse in the bin ahead of the compactor blade thus being effectively compacted in the direction of the back 3 of said bin.

The power mechanism for the compactor blade 17 comprises a pair of relatively short, hydraulic pressure actuated, laterally spaced power cylinders 19 disposed in the space between the lid 13 and said compactor blade; the latter, as described, normally closely underlying the lid, but spaced therefrom. Each power cylinder 19 is front-end pivoted, as at 20, to the front of the lid 13, and thence extends at a normally rearward and downward incline; the piston rods 21—which are normally contracted—being pivoted at their free ends, as at 22, to the compactor blade 17 substantially midway between the front and rear thereof. The included angle between the lid 13 and compactor blade 17 is such that the power cylinders have an effective thrust relation to said compactor blade.

The power cylinders 19 are of double-acting type, and are adapted to be reversibly actuated (under manual control) as follows:

An electric motor driven, hydraulic pump and control valve unit 23 is mounted exteriorly on the front of the bin and includes an upstanding manual control lever 24.

Two hydraulic conduit systems, indicated at 25 and 26, lead from the unit 24 to the power cylinders; the conduit system 25 connecting to the power cylinders 19 in parallel at one end, and the conduit system 26 connecting to said power cylinders in parallel at the other end. When the control lever 24 of unit 23 is moved to one position from an "off" or neutral position (and, of course, with both latches 7 and 16 engaged), the unit 23 is energized and operates so that the power cylinders are actuated (through conduit system 25) and extend, causing the compactor blade 17 to forcefully swing downwardly and sweep into the bin to compact refuse therein. Thereafter, with the control lever 24 is moved to another position relative to its "off" or neutral position, the unit 23 is again energized and operates so that the power cylinders are actuated (through conduit system 26) in reverse and contract which returns the compactor blade to its normal position closely underlying the lid. The control lever 24 is then returned to its "off" or neutral position, and in which the electric current to the unit 23—as supplied by a cable 27—is automatically discontinued.

The conduit systems 25 and 26 include flexible portions 28 and 29, respectively, spanning between the cover 5 and lid 13 whereby the latter can be opened and closed without interference.

Suitable interlocks or safety devices (not shown) are provided so that the unit 23, and consequently the compactor blade 17, cannot be placed in operation unless the latches 7 and 16 are engaged.

Figure 7:
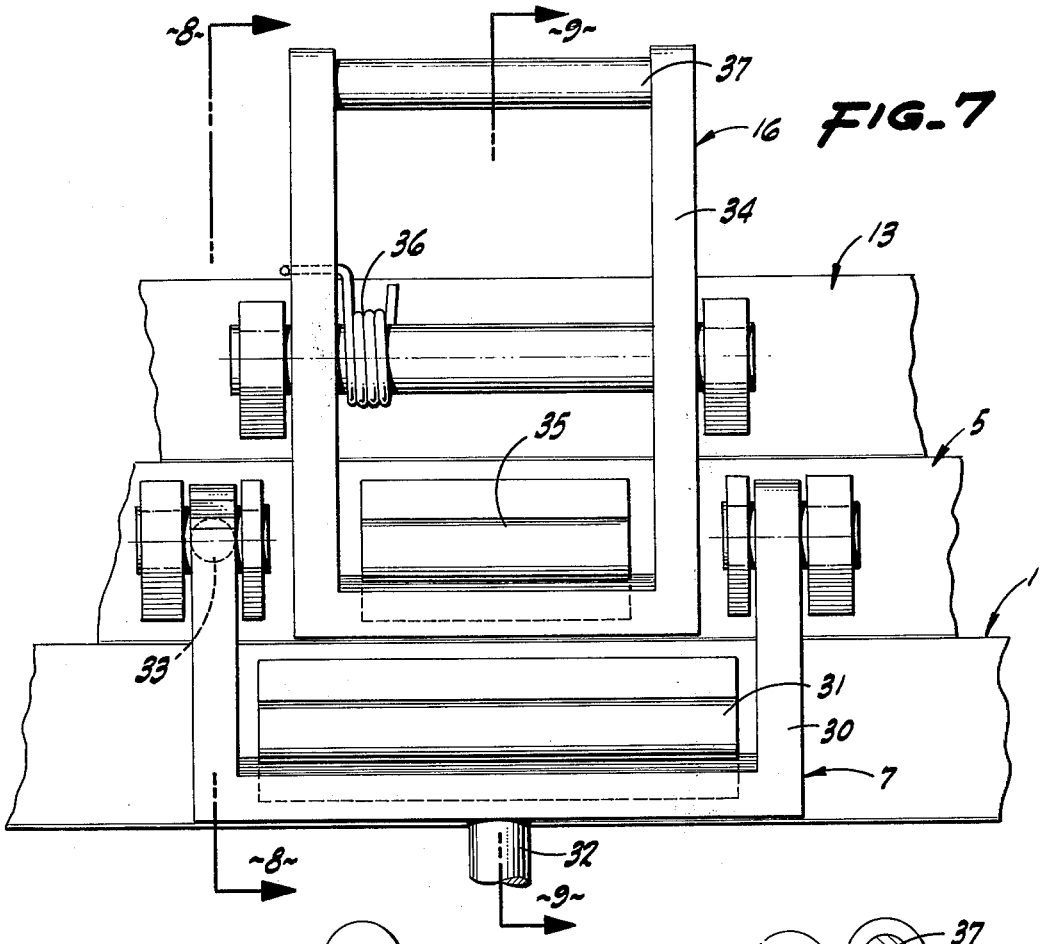
FIG. 7 is an enlarged, fragmentary, front elevation showing the lid latch and the cover latch engaged.
Figure 8:
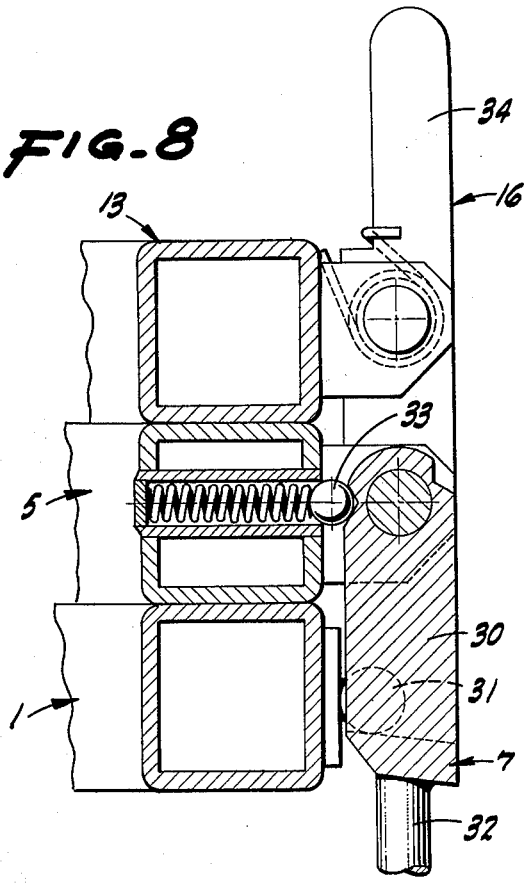
FIG. 8 is a fragmentary, transverse, sectional elevation taken substantially on line 8—8 of FIG. 7, with both latches engaged.
Figure 9:
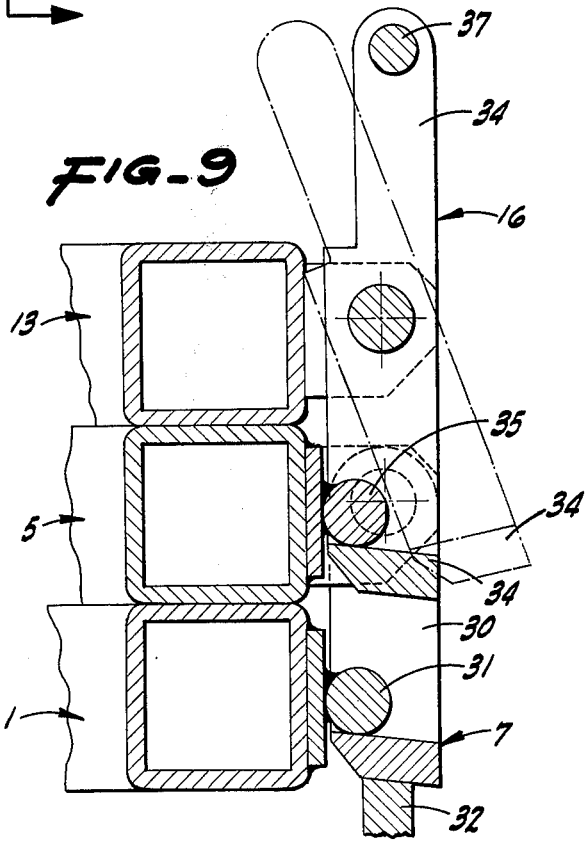
FIG. 9 is a fragmentary, transverse, sectional elevation taken substantially on line 9—9 of FIG. 7, with both latches engaged, but the position of the lid latch in open position being indicated in broken lines.

The latches 7 and 16—in a preferred form—are illustrated in FIGS. 7, 8, and 9. While, for the purpose of this specification, a detailed structural description of such latches is unnecessary, it will be recognized that the latch 7 includes a depending, pivotally mounted, swingable yoke 30 which—when the cover 5 is closed—normally engages a latch bar 31 on the bin. The yoke 30 is swung between engaged and disengaged positions by a short, depending rod 32; the yoke 30 being normally but releasably held in engaged position by a spring-pressed detent 33. The latch 16 likewise includes a depending, pivotally mounted, swingable yoke 34 which—when the lid 13 is closed—releasably engages, under the influence of the torque spring 36, a latch bar 35 on the cover 5. The yoke 34 is extended upwardly above its axis and includes a transverse hand grip 37.

To open lid 13 to deposit refuse in the bin, a person first grasps hand grip 37 and pushes forwardly, whereupon the yoke 34 escapes latch bar 35 and disengages latch 16. When the lid is returned to its closed position, the latch 16 automatically re-engages and thereafter—by appropriate manipulation of control lever 24—the hydraulic pump and valve unit 23 is placed in operation, whereupon the compactor blade 17 forcefully sweeps downwardly in the bin and compacts the refuse therein toward the back 3 of said bin.

From the foregoing description, it will be readily seen that there has been produced such a refuse bin with power-actuated compactor blade as substantially fulfills the objects of the invention, as set forth herein.

While this specification sets forth in detail the present and preferred construction of the refuse bin with power-actuated compactor blade, still in practice such deviations from such detail may be resorted to as do not form a departure from the spirit of the invention as defined by the appended claims.

I claim:

1. In a portable refuse bin embodying a normally closed cover, the cover being hinged to the bin for gravitational opening to permit discharge of refuse from the bin upon inversion thereof, a normally engaged but releasable latch between the bin and cover, the cover having an opening through which refuse can be deposited in the bin, a normally closed lid embracing such opening, the lid being hinged to the cover for manual opening to permit such deposit of refuse, and a normally engaged but releasable latch between the lid and the cover; the improvement characterized by the inclusion of a compactor blade normally closely underlying the lid, means hinging the compactor blade on the lid for downward pivotal sweeping therefrom into the bin, power means confined in the space between the lid and compactor blade and mounted in direct connection therebetween, said power means being operative, when the lid is closed and latched, to forcefully pivotally sweep said compactor blade downwardly into the bin to compact refuse previously deposited therein, and means on the bin to control the power means from exteriorly of said bin.

2. A portable refuse bin, as in claim 1, in which the latch means are at the front of the bin; the compactor blade being transversely hinged at the rear to the corresponding portion of the lid, and the power means comprising a fluid pressure power cylinder assembly direct connected between the lid and the compactor blade in effective thrust relation to the latter.

3. A portable refuse bin, as in claim 2, in which the power cylinder assembly comprises normally contracted, transversely spaced power cylinders pivoted at one end to the lid adjacent the front thereof and pivoted at the other end to the compactor blade intermediate its ends.

4. A refuse bin, as in claim 3, including a driven hydraulic pump and valve unit having an accessible manual control member, the power cylinders being of double-acting type, and conduit systems connected between such unit and power cylinders adapted to simultaneously actuate the latter to extend or contract the same, selectively.

5. A portable refuse bin, as in claim 1, in which the lid is rear-hinged to the cover; and said power means comprises a fluid pressure power cylinder pivoted at one end to the lid and pivoted at the other end to the compactor blade a distance ahead of the rear hinge thereof.

6. A portable refuse bin, as in claim 1, in which the power means includes a double-acting, fluid pressure power cylinder, a driven hydraulic pump and valve unit mounted on the bin and having an accessible manual control member, and a conduit system between said unit and power cylinder assembly adapted, under control by said member, to cause actuation of said power cylinder, reversibly and selectively.

* * * * *